US010418697B2

(12) United States Patent
Kashiwagi

(10) Patent No.: US 10,418,697 B2
(45) Date of Patent: Sep. 17, 2019

(54) ANTENNA APPARATUS AND ELECTRONIC DEVICE

(71) Applicant: Toshiba Client Solutions CO., LTD., Koto-Ku, Tokyo (JP)

(72) Inventor: Ippei Kashiwagi, Ome Tokyo (JP)

(73) Assignee: TOSHIBA CLIENT SOLUTIONS CO. LTD., Tokyo (JP)

( * ) Notice: Subject to any disclaimer, the term of this patent is extended or adjusted under 35 U.S.C. 154(b) by 98 days.

(21) Appl. No.: 15/441,157

(22) Filed: Feb. 23, 2017

(65) Prior Publication Data

US 2017/0250459 A1 Aug. 31, 2017

Related U.S. Application Data

(60) Provisional application No. 62/300,044, filed on Feb. 25, 2016.

(51) Int. Cl.

| | |
|---|---|
| ***H01Q 1/24*** | (2006.01) |
| ***H01Q 1/36*** | (2006.01) |
| ***H01Q 1/38*** | (2006.01) |
| ***H01Q 1/48*** | (2006.01) |
| ***H01Q 7/00*** | (2006.01) |
| ***H01Q 9/42*** | (2006.01) |
| ***H01Q 21/30*** | (2006.01) |
| ***H01Q 5/371*** | (2015.01) |

(Continued)

(52) U.S. Cl.

CPC ..... *H01Q 1/38* (2013.01); *H01Q 5/371* (2015.01); *H01Q 5/378* (2015.01); *H01Q 7/00* (2013.01); *H01Q 9/42* (2013.01); *H01Q 21/30* (2013.01); *H01Q 1/2266* (2013.01); *H01Q 1/243* (2013.01)

(58) Field of Classification Search

CPC ..... H01Q 1/38; H01Q 5/378; H01Q 5/371; H01Q 21/30; H01Q 7/00; H01Q 9/42; H01Q 1/243; H01Q 1/2266

See application file for complete search history.

(56) References Cited

U.S. PATENT DOCUMENTS

| | | | |
|---|---|---|---|
| 6,239,753 | B1 | 5/2001 | Kado et al. |
| 7,982,616 | B2 | 7/2011 | Banerjee et al. |
| 8,941,548 | B2 | 1/2015 | Kashiwagi et al. |

(Continued)

FOREIGN PATENT DOCUMENTS

| | | |
|---|---|---|
| JP | 10-041741 | 2/1998 |
| JP | 2011-519542 | 7/2011 |

(Continued)

*Primary Examiner* — Hai V Tran
*Assistant Examiner* — Michael M Bouizza
(74) *Attorney, Agent, or Firm* — Rutan & Tucker, LLP

(57) ABSTRACT

According to one embodiment, an antenna apparatus includes first line which has a feed end connected to a feed point and an open end, and is L-shaped, and second line which has a first end connected to a branch point between a bend portion of first line and the feed point and a second end connected to a first ground point, and is L-shaped. First line includes first portion which is elongated from the feed end to the bend portion, and second portion which is elongated from the bend portion to the open end. Second line includes third portion which is elongated from the branch point to a bend portion, and fourth portion which is elongated from the bend portion to the first ground point. The second portion and the third portion are opposed to each other.

10 Claims, 7 Drawing Sheets

(51) Int. Cl.
*H01Q 5/378* (2015.01)
*H01Q 1/22* (2006.01)

(56) References Cited

U.S. PATENT DOCUMENTS

| | | | | |
|---|---|---|---|---|
| 2009/0207026 | A1 | 8/2009 | Banerjee et al. | |
| 2011/0043412 | A1 | 2/2011 | Kim | |
| 2012/0194390 | A1* | 8/2012 | Endo | H01Q 1/243 343/700 MS |
| 2013/0050036 | A1 | 2/2013 | Kashiwagi et al. | |
| 2013/0234903 | A1* | 9/2013 | Kwak | H01Q 1/243 343/750 |
| 2014/0354484 | A1 | 12/2014 | Kashiwagi et al. | |

FOREIGN PATENT DOCUMENTS

| | | |
|---|---|---|
| JP | 2013-051501 | 3/2013 |
| JP | 2014-236323 | 12/2014 |

* cited by examiner

ANTENNA APPARATUS AND ELECTRONIC DEVICE

CROSS-REFERENCE TO RELATED APPLICATIONS

This application claims the benefit of U.S. Provisional Application No. 62/300,044, filed Feb. 25, 2016, the entire contents of which are incorporated herein by reference.

FIELD

Embodiments described herein relate generally to an antenna apparatus and an electronic device comprising the antenna apparatus.

BACKGROUND

Recently, as wireless communication service is diversified, built-in antennas of typical portable electronic devices such as mobile phones, smartphones, personal digital assistants (PDAs), tablet computers, and navigators have adapted to multiple frequency bands and high-speed wireless communication (for example, antennas conforming to the Long-Term Evolution in Unlicensed spectrum/Licensed Assisted Access using LTE [LTE-U/LAA] technology have been developed). In a portable electronic device, although there is demand for an antenna adaptable to an even higher frequency band, a higher priority is given to miniaturization of the portable electronic device, and thus the arrangement area of the antenna cannot be further expanded.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings. In general, according to one embodiment, an antenna apparatus comprises: a first line which has a feed end connected to a feed point and an open end, and is L-shaped and bent at a first bend portion between the feed end and the open end; and a second line which has a first end connected to a branch point between the first bend portion and the feed point and a second end connected to a first ground point, and is L-shaped and bent at a second bend portion between the first end and the second end, wherein the first line includes a first portion which is elongated from the feed end to the first bend portion, and a second portion which is elongated from the first bend portion to the open end, the second line includes a third portion which is elongated from the branch point to the second bend portion, and a fourth portion which is elongated from the second bend portion to the first ground point, and the second portion and the third portion are opposed to each other.

Embodiments will be further described hereinafter with reference to the accompanying drawings.

First Embodiment

Figure 1:
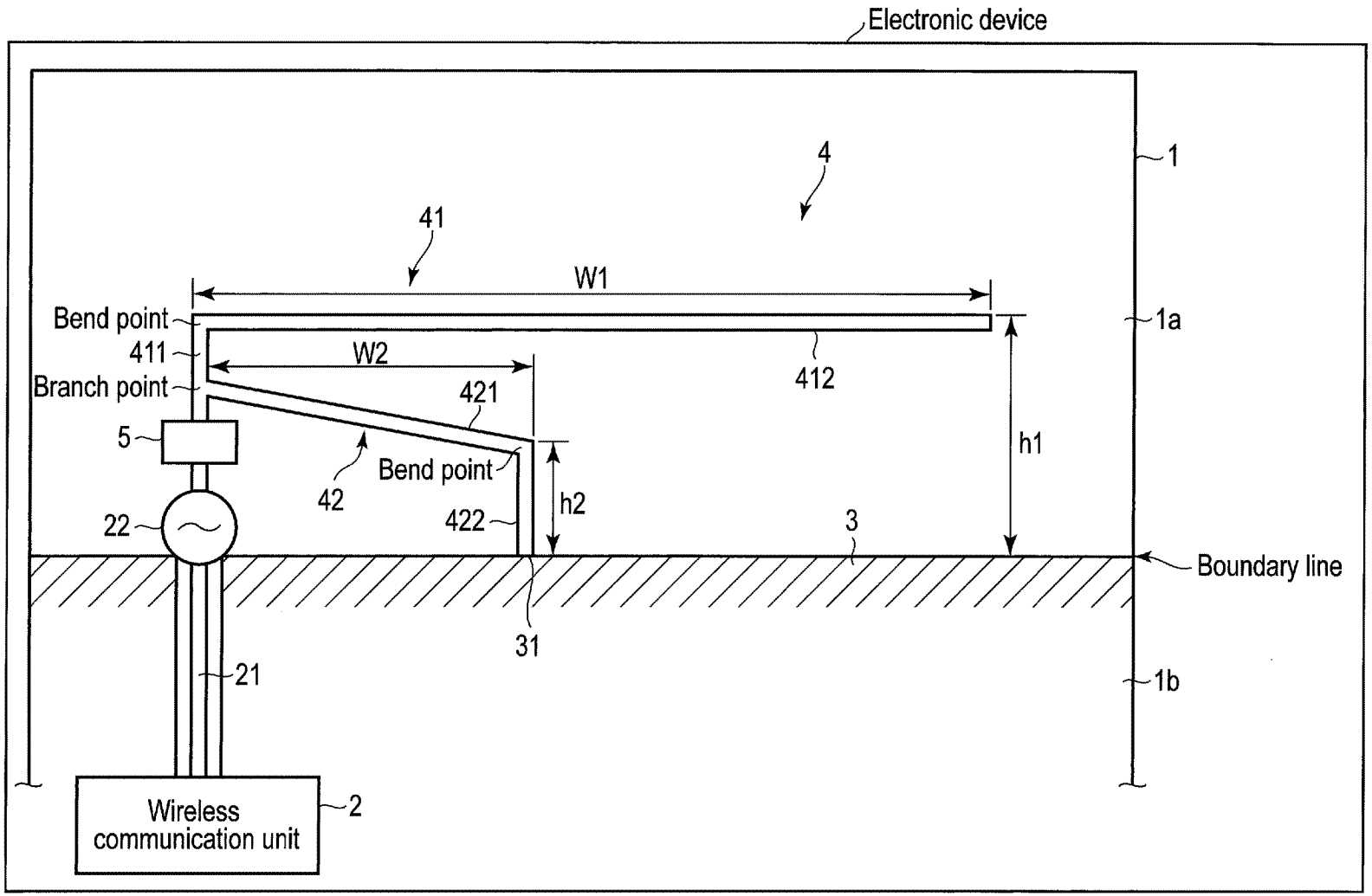
FIG. 1 is a diagram showing the structure of an electronic device comprising an antenna apparatus of a first embodiment.

FIG. 1 is a diagram showing the structure of an electronic device comprising an antenna apparatus of a first embodiment. The electronic device is a notebook computer or a television receiver which comprises a wireless interface, and in the housing (not shown) of the electronic device, a printed circuit board 1 is accommodated.

Note that the electronic device also includes, in addition to a notebook computer or a television receiver, a mobile phone, a smartphone, a personal digital assistant (PDA), or a portable device such as a tablet computer or a navigator. Further, the printed circuit board 1 may be formed of a part of the metal housing or may be formed of a metal member such as a copper foil.

The printed circuit board 1 includes a first area 1*a* and a second area 1*b*. Note that, for the sake of convenience, the first area 1*a* and the second area 1*b* will be assumed to be divided by a straight line, and the straight line will be referred to as the boundary of the first area 1*a* and the second area 1*b*.

In the first area 1*a*, a transmission line pattern such as a microstrip line is formed, and the transmission line pattern constitutes an antenna apparatus 4. In the second area 1*b*, a ground pattern area 3 is formed along the boundary with the first area 1*a*. Note that, on the back surface of the printed circuit board 1, a plurality of circuit modules which are necessary for constituting the electronic device are mounted, and the circuit modules include a wireless communication unit 2.

The wireless communication unit 2 has the function of transmitting and receiving a wireless signal using a channel frequency assigned to a target wireless communication system. Further, a feed terminal (feed point) 22 is provided near the boundary of the first area 1*a* and the second area 1*b*, and the wireless communication unit 2 is connected to the feed terminal 22 via a feed line 21 which is formed as a feed line pattern in the second area 1*b*.

The antenna apparatus 4 comprises a first transmission line 41 which is formed as an L-shaped transmission line, wherein one end of the line is connected to the feed point 22 and the other end of the line is open, and further comprises a second transmission line 42 which is formed as an L-shaped transmission line, wherein one end of the line is connected to a branch point between the bend point of the L-shaped first transmission line 41 and the feed point and the other end of the line is connected to a ground terminal (ground point) 31 at the boundary of the ground pattern area 3. The first transmission line 41 comprises a first transmission line segment 411 (at a distance h1 from the boundary) which is elongated from the feed point to the bend point in the parallel direction to the boundary, and a second transmission line segment (of a length W1) 412 which is bent at the bend point in the parallel direction to the boundary and is elongated from the bend point to the other open end. Further, the second transmission line 42 comprises a third transmission line segment (of a length W2) which is elongated from the branch point to the bend point in the substantially parallel direction to the second transmission line segment 412, and a fourth transmission line segment 422 (at a distance h2 from the boundary) which is elongated from the bend point to the ground point 31. A capacitor element 5 is provided between the feed point and the branch point of the first transmission line 41.

Here, the first transmission line 41 is a monopole antenna element, and together with the second transmission line 42 as an auxiliary transmission line, the first transmission line 41 can constitute a first antenna element adapting to the low frequency band (850 MHz). In this case, the first transmission line 41 has a length conforming to the low frequency band (850 MHz), that is, a length of ¼ $\lambda_1$ where a predetermined communication frequency band $f_1$ has a wavelength $\lambda_1$.

Figure 2:
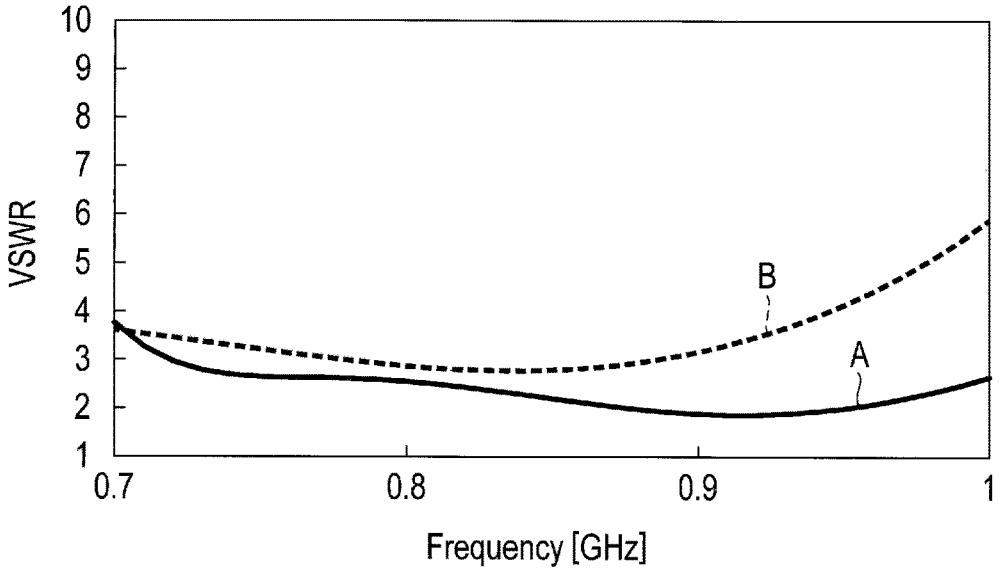
FIG. 2 is a graph comparatively showing the VSWR response of the antenna apparatus of FIG. 1 in the low frequency band (850 MHz) when a second transmission line segment and a third transmission line segment are opposed to each other, and the VSWR response of the antenna apparatus of FIG. 1 in the low frequency band (850 MHz) when the second transmission line segment and the third transmission line segment are not opposed to each other.

Further, the third transmission line segment 421 is opposed to the second transmission line segment 412 such that the third transmission line segment 421 is substantially parallel to the second transmission line segment 412. That is, the third transmission line segment 421 is opposed to the second transmission line segment 412. FIG. 2 comparatively show the VSWR response of the antenna apparatus in the low frequency band (850 MHz) of a case A where the second transmission line segment 412 and the third transmission line segment 421 are opposed to each other, and the VSWR response of the antenna apparatus of in the low frequency band (850 MHz) of a case B where the second transmission line segment 412 and the third transmission line segment 421 are not opposed to each other. As is evident from the graph of FIG. 2, when the second transmission line segment 412 and the third transmission line segment 421 are opposed to each other, the antenna apparatus produces excellent frequency characteristics.

Figure 3:
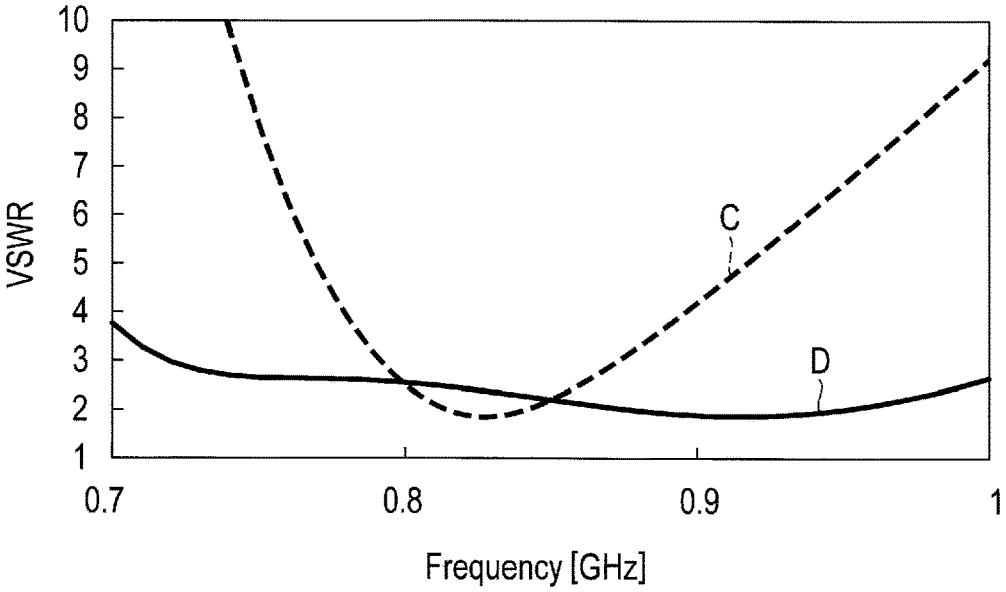
FIG. 3 is a graph comparatively showing the VSWR response of the antenna apparatus of FIG. 1 in the low frequency band (850 MHz) when a capacitor element is provided, and the VSWR response of the antenna apparatus of FIG. 1 in the low frequency band (850 MHz) when the capacitor element is not provided.
Figure 4A:
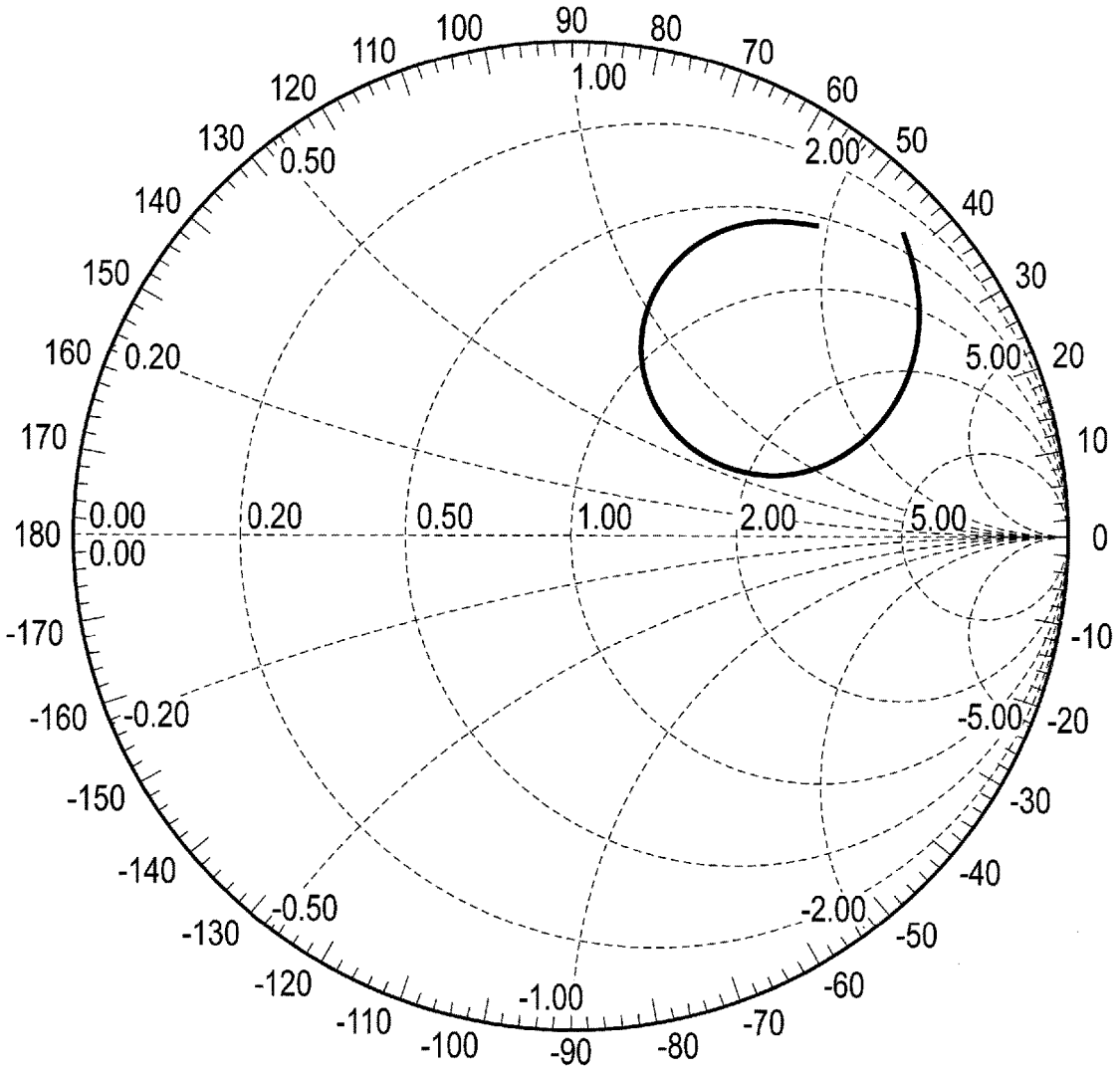
FIGS. 4A and 4B are Smith charts showing the impedance characteristics of the antenna apparatus of FIG. 1 in the low frequency band (850 MHz) of when the capacitor element is provided, and the impedance characteristics of the antenna apparatus of FIG. 1 in the low frequency band (850 MHz) of when the capacitor element is not provided, respectively.
Figure 4B:
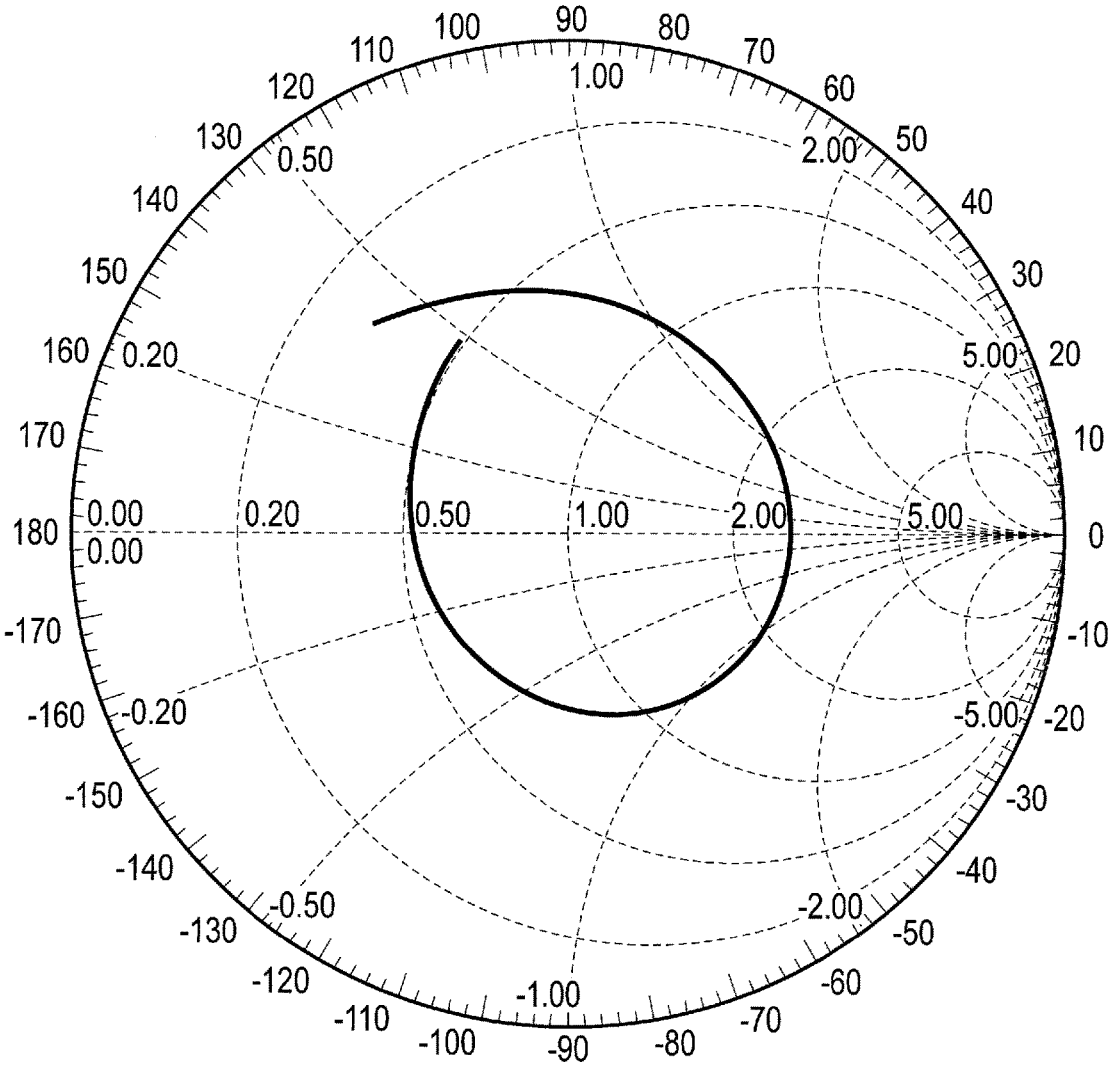

Further, to widen the antenna frequency response, the capacitor element 5 is provided. More specifically, in an angular frequency $\omega_1$ corresponding to a predetermined frequency band $f_1$, the capacitance C [pF] is set to a range of $1/(\omega_1 * C) < 250\Omega$. In the low frequency band (850 MHz), the VSWR response of a case C where the capacitor element 5 is not inserted and the VSWR response of a case D where the capacitor element 5 is inserted are comparatively shown in the graph of FIG. 3, and the impedance characteristics of the cases C and D are shown in the Smith charts of FIGS. 4A and 4B, respectively. As is evident from the graph of FIG. 3 and the Smith charts of FIGS. 4A and 4B, in the low frequency band (850 MHz), it is possible to widen the antenna frequency response by inserting the capacitor element 5. For example, the antenna apparatus is also operable in such a broader frequency band as the frequency band used in the 3G/LTE communication standards, that is, a frequency band of 700 MHz to 1 GHz.

In contrast to the first antenna element having the above-described structure, a loop is formed with the second transmission line 42 and the ground pattern area 3, and the loop can constitute a second antenna element adapting to the high frequency band (5 GHz). That is, the second transmission line 42 is set to a length of ½ $\lambda_2$ where the high frequency band (5 GHz) has a wavelength $\lambda_2$. In this way, the loop formed of the second transmission line 42 and the ground pattern area 3 functions as an antenna element which responds to the high frequency band (5 GHz). At this time, since the capacitor element 5 has low impedance in the high frequency band (5 GHz), the frequency characteristics will not be influenced by the capacitor element 5.

According to the structure of the above-described embodiment, a part of the transmission line pattern of the first antenna element adapting to the low frequency band is used as the transmission line pattern of the second antenna element adapting to the high frequency band, and thus the total arrangement area of the antenna apparatus can be reduced. Further, since the feed point can be shared between the antenna element adapting to the low frequency band and the antenna element adapting to the high frequency band, the arrangement area can be further efficiently used. Therefore, the antenna apparatus is sufficiently adaptable to a high frequency band of 5 GHz which is considered to be applied to the LTE-U/LAA technology.

Second Embodiment

Figure 5:
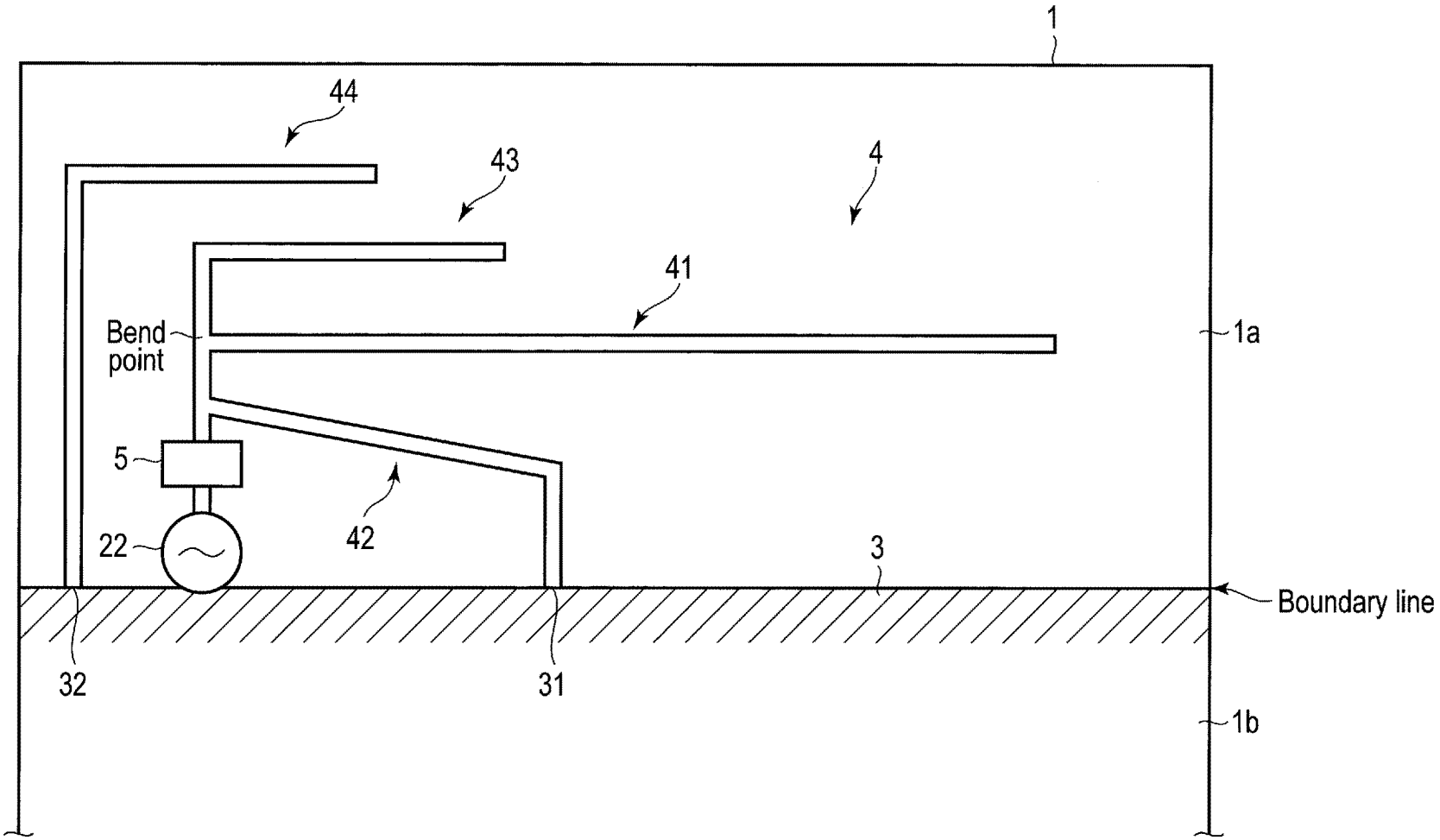
FIG. 5 is a diagram showing the structure of an electronic device comprising an antenna apparatus of a second embodiment.

FIG. 5 is a diagram showing the structure of an electronic device comprising an antenna apparatus of a second embodiment. In FIG. 5, parts the same as those of the electronic device of FIG. 1 will be denoted by the same reference numbers, and parts different from those of the electronic device of FIG. 1 will be mainly described.

In the present embodiment, the structure is mainly based on the structure of the first embodiment but is further provided with a third transmission line 43 and a fourth transmission line 44.

The third transmission line 43 is an L-shaped transmission line which is branched from the bend point of the first transmission line 41, and functions as a monopole antenna element.

The fourth transmission line 44 is an L-shaped transmission line which is elongated from a ground terminal 32 in a predetermined position on the boundary line on the side opposite to the ground terminal 31 across the feed point of the first transmission line 41, and functions as a parasitic antenna element. Note that the antenna resonant frequency of the third transmission line 43 and the antenna resonant frequency of the fourth transmission line 44 are different from each other by 5% or more. Further, the length of each of the third transmission line 43 and the fourth transmission line 44 are ¼ of the wavelengths of the respective resonant frequencies.

Figure 6:
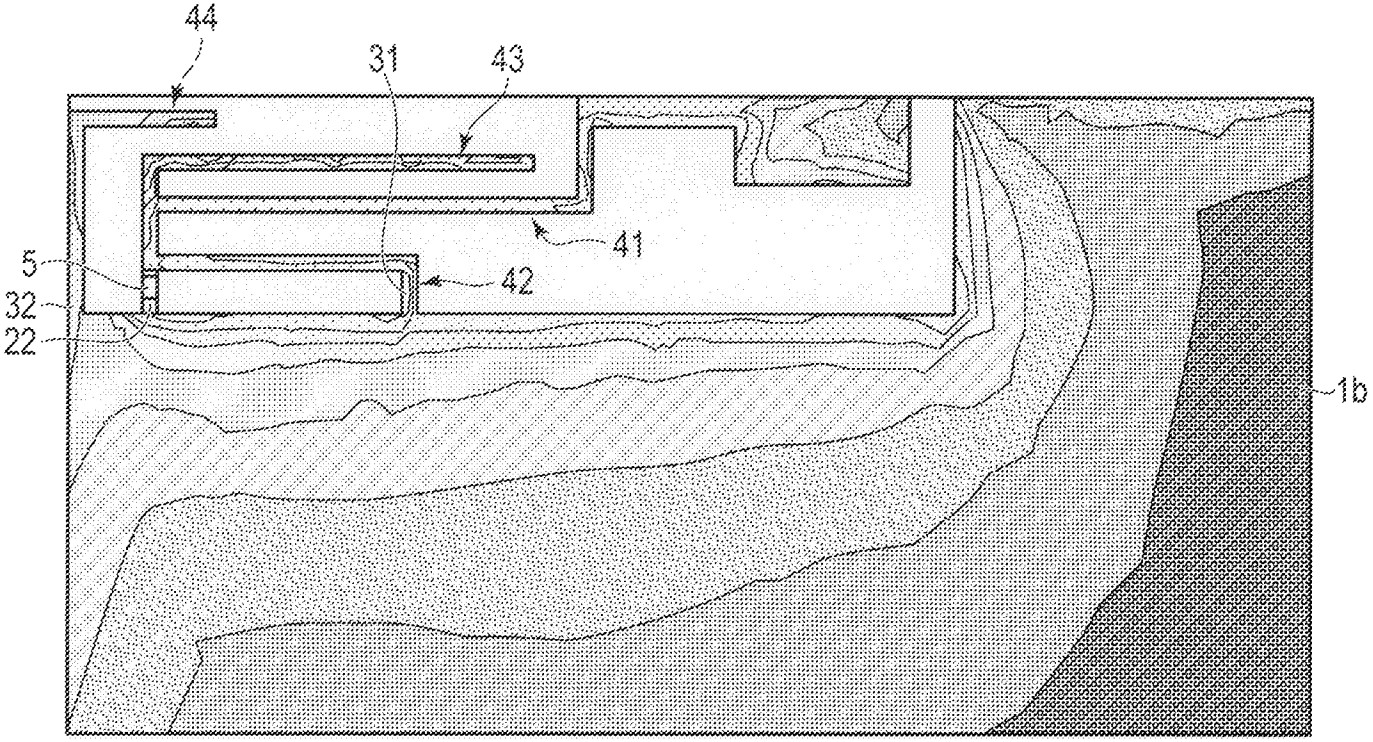
FIG. 6 is a diagram showing the current distribution of the antenna apparatus of FIG. 5 in the low frequency band (850 MHz).
Figure 7:
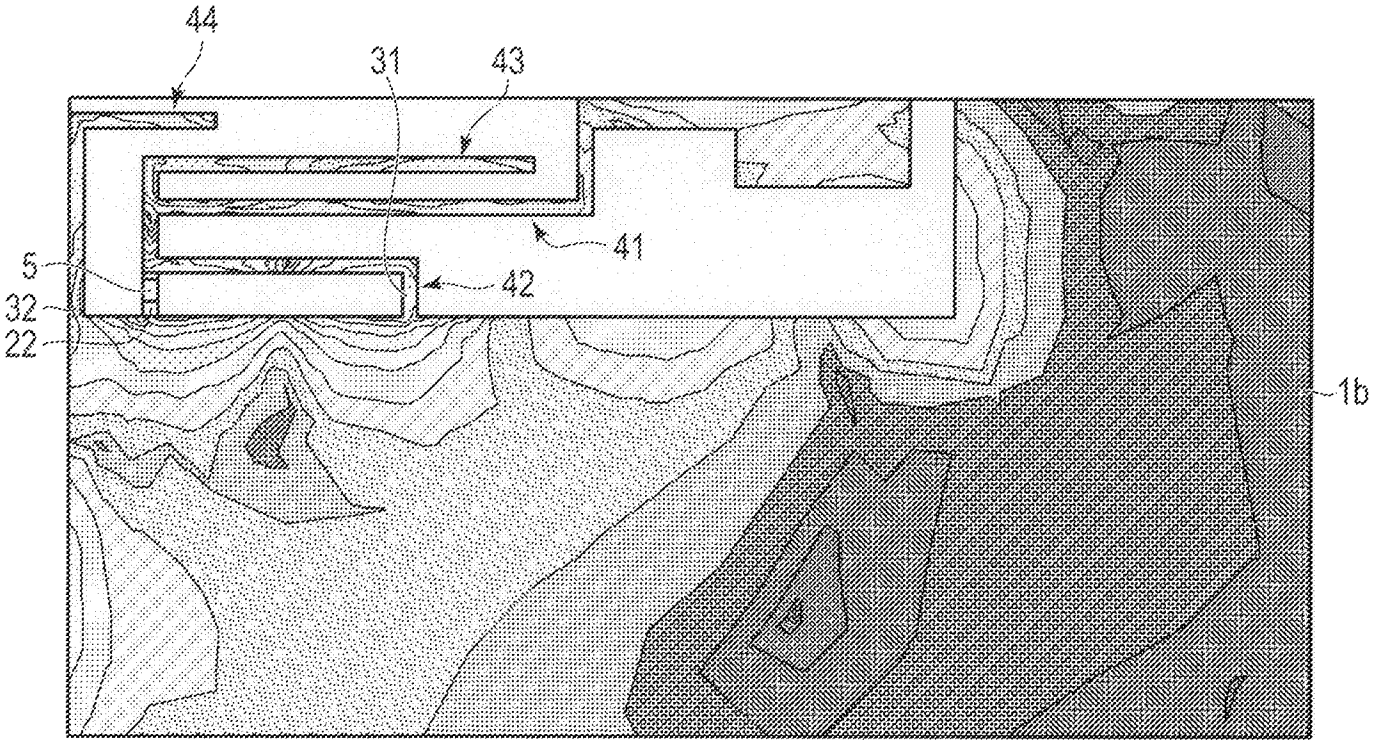
FIG. 7 is a diagram showing the current distribution of the antenna apparatus of FIG. 5 in the high frequency band (5 GHz).

In the above-described structure, the operation of the second transmission line 42, that is, the operation of the auxiliary transmission line adapting to the low frequency band and the operation of the loop antenna transmission line adapting to the high frequency band will not affect the antenna operation of the third transmission line and the operation of the fourth transmission line, and thus the antenna apparatus can achieve excellent characteristics. FIG. 6 shows the current distribution of the antenna apparatus shown in FIG. 5 in the low frequency band (850 MHz), and FIG. 7 shows the current distribution of the antenna apparatus shown in FIG. 5 in the high frequency band (5 GHz). In FIGS. 6 and 7, a white area (bright area) indicates high current. Note that, in FIGS. 6 and 7, according to the wavelength of the communication frequency, a predetermined pattern area is further connected to the end of the first transmission line 41. As is evident from FIGS. 6 and 7, the loop resonance of the second transmission line 42 does not affect the antenna resonance of the third transmission line 43 and the fourth transmission line 44. Therefore, according to the present embodiment, the antenna apparatus comprising the first to fourth antenna elements can adapt to multiple frequency bands including a high frequency band.

Note that, although the third transmission line 43 and the fourth transmission line 44 are further provided in the second embodiment, it is also possible to provide either one of the third transmission line 43 and the fourth transmission line 44 in the implementation of the invention.

As described above, according to the embodiments, a compact antenna apparatus adapting to an additional frequency band of future-generation wireless communication modes, in particular, a candidate frequency band for the LTE-U/LAA technology. According to the antenna apparatus, excellent electromagnetic radiation can be realized without any additional antenna elements in such an additional frequency band where electromagnetic radiation could not have been realized by conventional technology. In this way, the antenna apparatus realize both miniaturization and high performance.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An antenna apparatus comprising:

a first line including a feed end connected to a feed point and an open end, the first line is L-shaped and bent at a first bend portion between the feed end and the open end, and the first line is used in a low frequency band; and a second line including a first end connected to a branch point between the first bend portion and the feed end and a second end connected to a first ground point, the second line is L-shaped and bent at a second bend portion between the first end and the second end, and the second line is used in the low frequency band and a high frequency band, wherein the first line includes a first portion which is elongated from the feed end to the first bend portion, and a second portion which is elongated from the first bend portion to the open end, the first line is a monopole antenna element and has a length of one-quarter of a first wavelength ($\frac{1}{4}\lambda_1$) where the low frequency band has the first wavelength $\lambda_1$, the second line includes a third portion which is elongated from the branch point to the second bend portion and is opposed to the second portion of the first line, and is used as an auxiliary transmission line, and a fourth portion which is elongated from the second bend portion to the first ground point and is opposed to the first portion of the first line, and forms a loop antenna element with the first portion and a ground area including the first ground point, and the second line has a length of one-half of a second wavelength ($\frac{1}{2}\lambda_2$) where the high frequency band has the second wavelength $\lambda_2$.

2. The antenna apparatus of claim 1, further comprising:

a third line which is L-shaped line, one end of the line being connected to the first bend portion of the first line, the other end of the line being open, and is used in a multi-band containing the high-frequency band, wherein the third line is a monopole antenna element and has a length of one-quarter of a wavelength of an antenna resonant frequency.

3. The antenna apparatus of claim 1, further comprising:

a fourth line which is an L-shaped line, one end of the line being connected to a second ground point provided on the side opposite to first ground point across the feed point, the other end of the line being open, and is used in a multi-band containing the high-frequency band, wherein the fourth line is a parasitic antenna element and has a length of one-quarter of a wavelength of an antenna resonant frequency.

4. The antenna apparatus of claim 1, wherein the first wavelength $\lambda_1$ is different than the second first wavelength $\lambda_2$.

5. The antenna apparatus of claim 4, wherein the first wavelength $\lambda_1$ has a greater periodicity than the second first wavelength $\lambda_2$.

6. An electronic device comprising:

a wireless communication unit which transmits and receives a wireless signal; and an antenna apparatus which includes first and second lines for transmitting and receiving the wireless signal; wherein the first line includes a feed end connected to a feed point and an open end, the first line is L-shaped and bent at a first bend portion between the feed end and the open end, and the first line is used in a low frequency band; and the second line includes a first end connected to a branch point between the first bend portion and the feed end and a second end connected to a first ground point, the second line is L-shaped and bent at a second bend portion between the first end and the second end and the second line is used in the low frequency band and a high frequency band, the first line includes a first portion which is elongated from the feed point to the first bend portion, and a second portion which is elongated from the first bend portion to the open end, the first line operates as a monopole antenna element and has a length of one-quarter of a first wavelength ($\frac{1}{4}\lambda_1$) where the low frequency band has the first wavelength $\lambda_1$, the second line includes a third portion which is elongated from the branch point to the second bend portion and is opposed to the second portion of the first line, the first line is used as an auxiliary line, and a fourth portion which is elongated from the second bend portion to the first ground point and opposed to the first portion of the first line and forms a loop antenna element with the first portion and a ground area including the first ground point, and the second line has a length of one-half of a second wavelength ($\frac{1}{2}\lambda_2$) where the high frequency band has the second wavelength $\lambda_2$.

7. The electronic device of claim 6, further comprising:

a third line which is an L-shape line, one end of the line being connected to the first bend portion of the first line, the other end of the line being open, and is used in a multi-band containing the high frequency band, wherein the third line is a monopole antenna element and has a length of one-quarter of a wavelength of an antenna resonant frequency.

8. The electronic device of claim 6, further comprising:

a fourth line which is an L-shaped line, one end of the line being connected to a second ground point provided on the side opposite to the first ground point across the feed point, the other end of the line being open, and is used in a multi-band containing the high-frequency band, wherein the fourth line is a parasitic antenna element and has a length of one-quarter of a wavelength of an antenna resonant frequency.

9. The electronic device of claim 6, wherein the first wavelength $\lambda_1$ is different than the second first wavelength $\lambda_2$.

10. The electronic device of claim 9, wherein the first wavelength $\lambda_1$ has a greater periodicity than the second first wavelength $\lambda_2$.

* * * * *